US006823559B2

(12) United States Patent
Kaffenberger et al.

(10) Patent No.: US 6,823,559 B2
(45) Date of Patent: Nov. 30, 2004

(54) FRONT BRUSH ATTACHMENT DEVICE FOR VACUUM CLEANER

(75) Inventors: Dieter Kaffenberger, Wiehl (DE); Klaus-Dieter Riehl, Drolshagen (DE)

(73) Assignee: Wessel-Werk GmbH, Reichshof-Wildbergerhütte (DE)

( * ) Notice: Subject to any disclaimer, the term of this patent is extended or adjusted under 35 U.S.C. 154(b) by 326 days.

(21) Appl. No.: 10/156,776

(22) Filed: May 22, 2002

(65) Prior Publication Data

US 2003/0145422 A1 Aug. 7, 2003

(30) Foreign Application Priority Data

Feb. 7, 2002 (DE) ..... 202 01 881 U

(51) Int. Cl.[7] ..... A47L 9/32; A47L 5/32

(52) U.S. Cl. ..... 15/410; 15/377

(58) Field of Search ..... 15/327.1, 327.2, 15/327.3, 327.4, 327.5, 327.6, 327.7, 377, 410

(56) References Cited

U.S. PATENT DOCUMENTS 4,423,534 A * 1/1984 Lyman et al. ..... 15/410
4,700,429 A * 10/1987 Martin et al. ..... 15/377
5,537,710 A * 7/1996 Selewski et al. ..... 15/377
2001/0027586 A1 * 10/2001 Lee ..... 15/377
2001/0037536 A1 * 11/2001 Kim ..... 15/361

FOREIGN PATENT DOCUMENTS

JP 10328098 * 12/1998

* cited by examiner

*Primary Examiner*—Terrence R. Till
(74) *Attorney, Agent, or Firm*—Collard & Roe, P.C

(57) ABSTRACT

A front brush attachment device for a vacuum cleaner comprises a multi-component housing, a rotationally driven brush roller, and a rotating and tilting joint for connecting the vacuum cleaner. The rotating and tilting joint has a tilting joint piece inserted in a suction duct of the housing, as well as a short, rotatable joint tube, which is connected with the tilting joint piece in a rotating manner. The tilting joint piece is supported in the housing in a manner permitting it to revolve about an axle aligned transversely in relation to the suction duct. The short, rotatable joint tube is mounted on a cylindrical connector piece with rotational mobility. A protrusion on the housing and a recess on the rotatable joint tube engage each other in the locking position and secure the short, rotatable joint tube against rotation. A spring-loaded locking lever is supported on the housing, which, in the locking position, engages a shoulder located on the periphery of the tilting joint piece.

7 Claims, 2 Drawing Sheets

FRONT BRUSH ATTACHMENT DEVICE FOR VACUUM CLEANER

BACKGROUND

The invention relates to a front brush attachment device for a vacuum cleaner that acts as a suction head. The housing of the suction head has a brush roller chamber that is open on its bottom side, and a suction duct that feeds into the brush roller chamber. A rotationally driven brush roller is rotatably supported in the brush roller chamber. A rotating and tilting joint connects a vacuum cleaner to the housing. The joint has a tilting joint piece inserted in the suction duct, as well as a short, rotating joint tube connected in a rotational manner with the tilting joint piece. When pivoted upward, the rotating and tilting joint is moved into a locked position at a stop surface on the housing.

The front brush attachment device is intended for vacuum cleaners with a blower, a dust bag for receiving dirt, and a handle on its back side. The vacuum cleaner may be connected with the rotating and tilting joint of the front brush attachment device by a fixed or releasable connection. Vacuum cleaners having a front brush attachment device connected in a fixed manner are often referred to as upright vacuum cleaners.

The short, rotatable joint tube of the rotating and tilting joint is frequently angled, which permits steering of the suction head as it is moved. By rotating the handle connected with the vacuum cleaner, it is possible to steer the suction head to the right or left, allowing for vacuum cleaning in poorly accessible areas. After the vacuum cleaner has been used, it is stored in an upright position. However, the mobility of a rotating and tilting joint poses the risk that a vacuum cleaner may tilt over to the right or left.

The present invention has a rotating and tilting joint that can lock preventing movement in all directions. When in the locked position, the vacuum cleaner can be stored in the upright position without being supported by a wall.

The locking device has a simple structure and is easily handled. Furthermore, clamping devices projecting from the outer side of the front brush attachment device are avoided.

SUMMARY

In the present invention, a front brush attachment device for a vacuum cleaner comprises a multi-component housing in the form of a suction head. The housing has a brush roller chamber that is open on its bottom side, and a suction duct feeding into the brush roller chamber. A rotationally driven brush roller is rotatably supported in the brush roller chamber. A rotating and tilting joint connects a vacuum cleaner to the housing. The rotating and tilting joint has a tilting joint piece that is inserted in the suction duct, as well as a short rotatable joint tube that is connected in a rotating manner with the tilting joint piece. Pivoting the rotating and tilting joint tube upward moves it into a locked position at a stop surface on the housing.

The tilting joint piece is supported in the housing and rotates about an axle that is aligned transversely in relation to the suction duct. The tilting joint piece is adapted to the cross section of the suction duct and is shaped like a short pipe. It has a cylindrical peripheral surface, against which the housing is sealed. The tilting joint piece also comprises a cylindrical connector piece, on which the short, rotating tube of the joint is mounted in a rotating manner.

Form-locking moldings exist in the form of a protrusion on the housing and a recess in the joint tube. The protrusion and recess engage in the locked position and secure the short, rotatable joint tube against rotation. The second locking element is a spring-loaded locking lever that is supported on the housing. When in the locked position, the locking lever engages a shoulder located on the periphery of the tilting joint piece. This prevents the tilting of the tilting joint piece. However, the tilting joint piece is only in the fully upright position when the protrusion and recess engage. This prevents the spring-loaded locking lever from engaging the shoulder until the protrusion and recess engage, simultaneously locking the joint from tilting and rotating.

The spring-loaded locking lever locks automatically when the rotating and tilting joint is pivoted upward against the stop surface on the housing. When it is in the locked position, the rotating and tilting joint is effectively secured not only against pivotal movements, but also against rotational movement. When the rotating and tilting joint is released from the locking lever, the joint has mobility in all directions.

According to a preferred embodiment of the invention, the housing is comprised of a bottom dish, an upper part connected with the bottom dish in a fixed manner, and a cover extending over the upper part. The bottom dish and the upper part jointly form the brush roller chamber and the suction duct. The bottom dish and upper part also encapsulate installation chambers where an electric motor for driving the brush roller, as well as electrical components are accommodated. The locking lever is supported in a rotating manner on the upper part and covered by the cover, except for a switching area that is accessible outside the housing. The cover may be plastic with thin walls.

The locking lever is U-shaped with journal pins molded onto its legs. The switching surface is molded to the end of at least one of the legs. The underside of this surface is acted upon by a pressure spring supported on the upper part. A locking tooth is molded onto the bridge of the U-shaped lever. The locking tooth is guided through a slot-like opening of the upper part of the housing where it engages the rotating and tilting joint in the locked position by locking into the shoulder.

According to a preferred embodiment of the invention, the upper part of the housing and the cover comprise cavities that are adapted to the range of swivel of the rotating and tilting joint, and are rounded at the sides. The cover has a protrusion in the rounded area of the cavity. When the rotating and tilting joint is in the locked position, the protrusion engages a recess provided on the periphery of the short joint tube, securing the joint against rotation.

BRIEF DESCRIPTION OF THE DRAWINGS

Other objects and features of the present invention will become apparent from the following detailed description considered in connection with the accompanying drawings which disclose one embodiment of the present invention. It should be understood, however, that the drawings are designed for the purpose of illustration only and not as a definition of the limits of the invention.

In the drawings, wherein similar reference characters denote similar elements through the several views.

DETAILED DESCRIPTION

Figure 1:
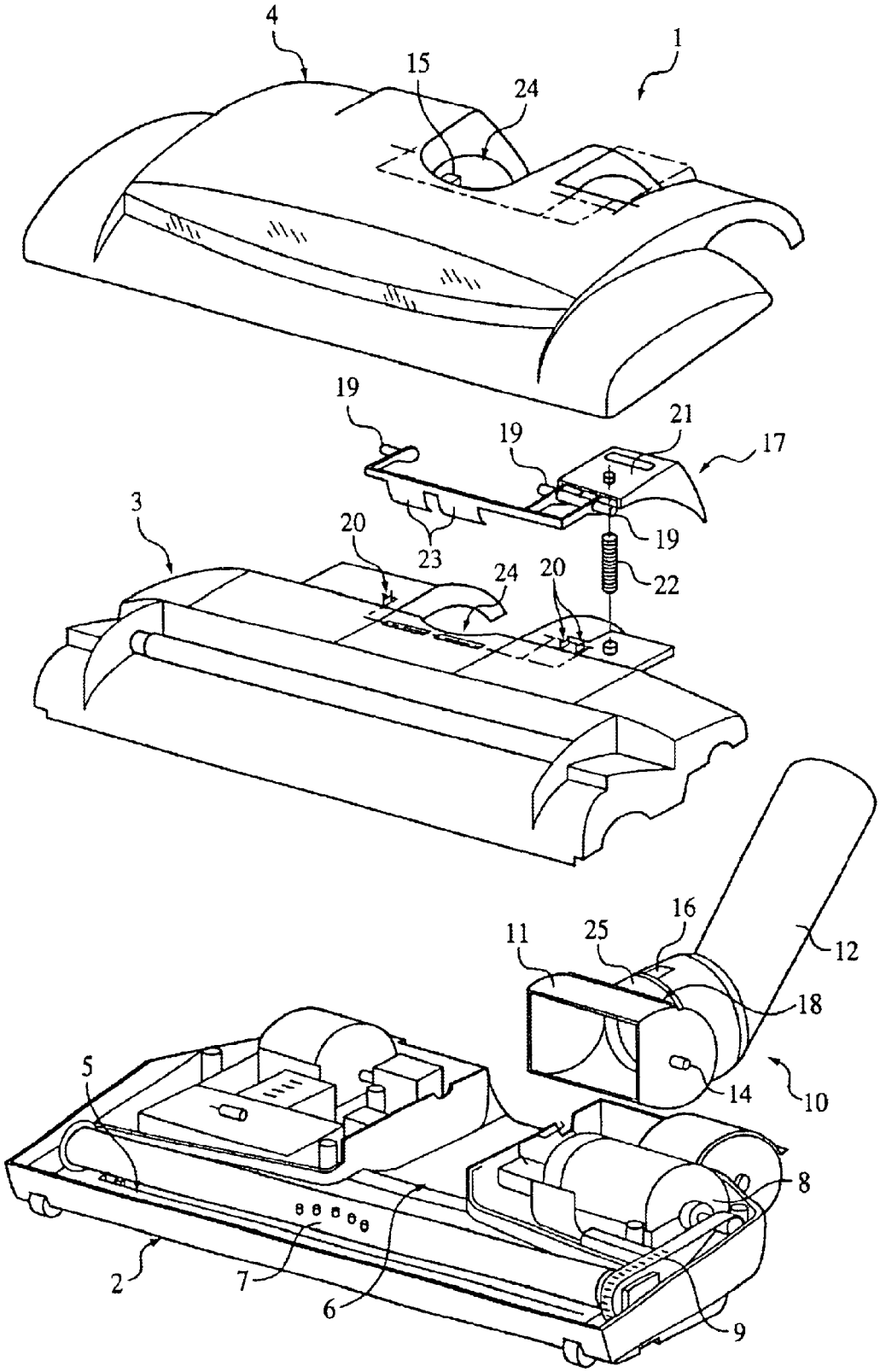
FIG. 1 shows an exploded view of a front brush attachment device for vacuum cleaners.
Figure 2:
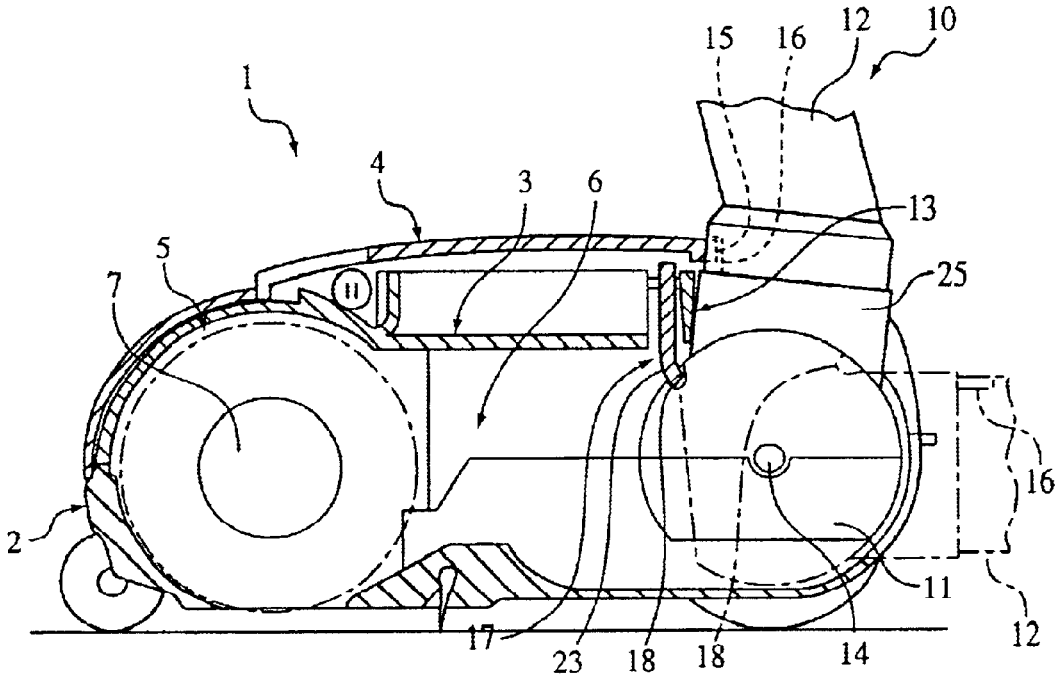
FIG. 2 shows a longitudinal cross-section through the object shown in FIG. 1.

Referring now in detail to the drawings, FIG. 1 shows a front brush attachment device having a multi-component housing 1 in the form of a suction head. Housing 1 has a bottom dish 2, an upper part 3 connected with bottom dish 2 in a fixed manner, and a cover 4 that extends over upper part 3. Housing 1 contains a brush roller chamber 5, which is open on the bottom side, and a suction duct 6 feeding into brush roller chamber 5. Suction duct 6 and brush roller chamber 5 are formed by the walls of upper part 3 and bottom dish 2. A brush roller 7 is supported in a rotating manner in brush roller chamber 5. Brush roller 7 is driven by an electric motor 8 via a toothed belt 9.

A connector device connects a vacuum cleaner to housing 1. The connector device is a rotating and tilting joint 10. Rotating and tilting joint 10 has a tilting joint piece 11, which is inserted in suction duct 6. Rotating and tilting joint 10 also has a short, rotatable joint tube 12 that is connected with tilting joint piece 11 with rotational mobility. Short, rotatable joint tube 12 is an angled tube. Pivoting it upward moves it into a locked position at a stop surface 13 on housing 1. Tilting joint piece 11 is supported in housing 1 in a rotating manner and rotates about an axle 14 aligned transversely in relation to suction duct 6. Tilting joint piece 11 has the shape of a short pipe and comprises a cylindrical peripheral surface. Housing 1 is sealed against the cylindrical peripheral surface. Tilting joint piece 11 comprises a cylindrical connector piece 25, on which short, rotating joint tube 12 is mounted in a rotating manner.

Upper part 3 and cover 4 comprise cavities 24, which are adapted to the range of swivel of rotating and tilting joint 10 and are rounded on the sides. A protrusion 15 projecting from the rounded area of cavity 24 is molded onto cover 4. In the locked position, protrusion 15 engages a corresponding recess 16 located on the periphery of short, rotatable joint tube 12, securing joint tube 12 against rotation. A spring-loaded locking lever 17 is supported on housing 1. In the locked position, locking lever 17 engages a shoulder 18 located on the cylindrical periphery of tilting joint piece 11, thereby preventing the movement of tilting joint piece 11. However, tilting joint piece 11 is only in the fully upright position when protrusion 15 and recess 16 engage. This prevents spring-loaded locking lever 17 from engaging shoulder 18 until protrusion 15 and recess 16 engage, simultaneously locking rotating and tilting joint 10 from tilting and rotating.

FIG. 1 shows that locking lever 17 is substantially U-shaped and supported on upper part 3 of housing 1 in a rotating manner. Journal pins 19 are molded on the legs of locking lever 17 and clipped into fork-shaped bearings 20 of upper part 3. A switching surface 21 is molded at the end of one of the legs, and acted upon from below by a pressure spring 22 supported on upper part 3. A locking tooth 23 is molded onto the bridge of U-shaped locking lever 17 and guided through a slot-like aperture of upper part 3. In the locked position, locking tooth 23 locks onto shoulder 18 of rotating and tilting joint 10.

In the locked position, pivotal movements of rotating and tilting joint 10 are blocked by locking lever 17, which engages shoulder 18 of tilting joint piece 11 from behind. Short, rotatable joint tube 12 is effectively secured against rotation at the same time. By actuating switching surface 21, locking tooth 23 is lifted by a pivotal movement of locking lever 17, and rotating and tilting joint 10 is released. The locking system as defined by the invention does not comprise any locking elements projecting from the outer side of the front brush attachment device.

Accordingly, while one embodiment of the present invention has been shown and described, it is to be under stood that many changes and modifications may be made thereunto without departing from the spirit and scope of the invention as defined in the appended claims.

What is claimed is:

1. A front brush attachment device for a vacuum cleaner comprising:

a. a multi component housing having a bottom side, a stop surface, and a protrusion;

b. a brush roller chamber disposed within said multi-component housing and open on said bottom side of said multi-component housing;

c. a suction duct disposed within said multi-component housing that feeds into said brush roller chamber;

d. a rotationally driven brush roller supported in a rotating manner in said brush roller chamber;

e. a spring-loaded locking lever, supported on said multi-component housing; and f. a rotating and tilting joint, connecting said multi-component housing to a vacuum cleaner, comprising:

i. a tilting joint piece having a shoulder on its periphery, wherein said tilting joint piece is inserted into said suction duct and supported in a rotational manner about an axle aligned transversely in relation to said suction duct;

ii. a rotatable joint tube coupled to said tilting joint piece with rotational mobility, wherein a recess is disposed on the connection end of said short rotatable joint tube; and iii. a cylindrical connector piece that couples said rotatable joint tube to said tilting joint piece and permits rotation of said rotatable joint tube;

wherein said rotating and tilting joint may be directed into a locked position at said stop surface of said multi-component housing by an upwardly directed pivotal movement, and wherein in said locked position said protrusion engages said recess locking and securing said short rotatable joint tube against rotation, while said spring-loaded locking lever engages said shoulder, preventing tilting of said tilting joint piece.

2. The front brush attachment device according to claim 1, wherein said multi-component housing comprises a bottom dish, an upper part connected with said bottom dish in a fixed manner, and a cover extending over said upper part; wherein said bottom dish and said upper part form said brush roller chamber and said suction duct, and wherein said locking lever is supported on said upper part in a rotating manner.

3. The front brush attachment device according to claim 2, wherein said locking lever is substantially U-shaped with two legs and comprises:

a plurality of journal pins molded onto said legs of said U-shaped lever;

a switching surface molded onto the end of at least one of said legs;

a pressure spring supported by said upper part, wherein said pressure spring acts on the underside of said switching surface; and a locking tooth molded onto a bridge of said U-shaped lever, wherein said locking tooth is guided through a slot-like aperture of said upper part, engaging said shoulder of said tilting joint piece in said locked position.

4. The front brush attachment device according to claim 2, wherein said upper part and said cover comprise cavities adapted to the range of pivoting of said rotating and tilting joint and wherein said protrusion is disposed in said cavity.

5. A front brush attachment device for a vacuum cleaner comprising:

a. a housing;

b. a rotating and tilting joint, connecting said housing to a vacuum cleaner;

c. a first locking device that prevents said rotating and tilting joint from rotating, and that locks said housing and said rotating and tilting joint when said rotating and tilting joint is in a substantially vertical position; and d. a second locking device for detachably coupling said rotating and tilting joint to said housing that prevents said rotating and tilting joint from tilting when said rotating and tilting joint is in a substantially vertical position.

6. The front brush attachment according to claim 5 wherein said second locking device comprises a spring loaded locking device supported on said housing.

7. The front brush attachment according to claim 5 wherein said first locking device comprises a protrusion and a recess.

* * * * *